US007021589B2

(12) United States Patent
Hess, Jr. et al.

(10) Patent No.: US 7,021,589 B2
(45) Date of Patent: Apr. 4, 2006

(54) CONTROL SYSTEM FOR OPTIMIZING THE OPERATION OF TWO OR MORE LOCOMOTIVES OF A CONSIST

(75) Inventors: Gerald James Hess, Jr., Erie, PA (US); Jan Alan Nagle, North East, PA (US); Shuo Chen, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/722,610

(22) Filed: Nov. 26, 2003

(65) Prior Publication Data

US 2004/0104312 A1 Jun. 3, 2004

Related U.S. Application Data

(62) Division of application No. 10/177,547, filed on Jun. 21, 2002, now Pat. No. 6,691,957.

(60) Provisional application No. 60/299,932, filed on Jun. 21, 2001.

(51) Int. Cl.
*B61C 5/00* (2006.01)

(52) U.S. Cl. ..... 246/187 R; 246/186; 246/182 R; 105/61; 701/19; 701/20

(58) Field of Classification Search ..... 246/187 C, 246/182 R, 187 R, 182 B, 182 C, 186, 167 R; 105/61; 318/370; 701/19, 20
See application file for complete search history.

(56) References Cited

U.S. PATENT DOCUMENTS

| | | | | |
|---|---|---|---|---|
| 4,344,364 | A * | 8/1982 | Nickles et al. | 105/62.1 |
| 4,401,035 | A * | 8/1983 | Spigarelli et al. | 105/61 |
| 4,582,280 | A | 4/1986 | Nichols et al. | |
| 4,602,335 | A * | 7/1986 | Perlmutter | 701/20 |
| 4,735,385 | A * | 4/1988 | Nickles et al. | 246/182 B |
| 5,581,472 | A | 12/1996 | Miller et al. | |
| 5,787,371 | A | 7/1998 | Balukin et al. | |
| 5,950,967 | A * | 9/1999 | Montgomery | 246/182 R |
| 5,969,643 | A * | 10/1999 | Curtis | 340/988 |
| 6,144,901 | A * | 11/2000 | Nickles et al. | 701/19 |
| 6,263,266 | B1 * | 7/2001 | Hawthorne | 701/19 |

* cited by examiner

*Primary Examiner*—Mark T. Le
(74) *Attorney, Agent, or Firm*—Senniger Powers; Carlos Hanze

(57) ABSTRACT

A system for controlling, a response to an operator, a consist of at least first and second locomotives having discrete operating modes. The system comprises an operator control, a first controller, a second controller, and a communication link. Alternatively, the system and method includes control modules which may be retrofitted to an existing consist control. The power operating modes of the locomotives within a consist are selected to optimize the operation of the consist. The operation of the consist may be optimized for any number of factors including optimizing for braking capacity, as a function of the location, base on a performance parameter which is a function of a performance profile or the location of a crew member.

19 Claims, 2 Drawing Sheets

CONTROL SYSTEM FOR OPTIMIZING THE OPERATION OF TWO OR MORE LOCOMOTIVES OF A CONSIST

This application is a division of U.S. application Ser. No. 10/177,547; filed Jun. 21, 2002 now U.S. Pat. No. 6,691, 957.

BACKGROUND OF THE INVENTION

This invention generally relates to an automatic consist management system and, in particular, a system and method for independently controlling each locomotive of a consist in order to optimize one or more operations of the locomotives.

In a current locomotive consist, the locomotive controls are linked together and are controlled in response to operator input provided to the master or lead locomotive. In general, locomotives operate in a discrete number of power modes, usually eight. These power modes are referred to as "notches" and the notch at which a particular lead locomotive is set will determine the speed of operation of the consist. In the current locomotive consist, an operator can only command all locomotives in the consist to run in the same notch. For example, in a three unit consist, when the operator moves the throttle to notch 6 in the lead unit, the same notch 6 command will be sent to the locomotive controllers of the other two units of the consist. This command is sent through a communication link, one example being a train line which is a 16 wire harness interconnecting the locomotives of the consist. Alternatively, a railroad wireless communication system such as disclosed, for example, in U.S. Pat. No. 4,582,280, incorporated herein by reference in its entirety, may be used to communicate between the lead unit and the remote units of a consist.

Although this system and method of operation of the consist provides simplicity, there is a need for a system which independently operates each of the locomotives so that the performance of the consist can be optimized.

BRIEF SUMMARY OF THE INVENTION

In an exemplary embodiment of the invention, a system for controlling, in response to an operator, a consist of at least first and second locomotives having discrete operating modes comprises an operator control, a first controller, a second controller, and a communication link. The operator control is for use by the operator to indicate a desired operating mode. The first controller responds to the desired operating mode as indicated by the operator control for controlling an operating mode of the first locomotive. The second controller responds to the desired operating mode as indicated by the operator control for controlling an operating mode of the second locomotive. In at least one mode of operation of the system, the operating mode of the second locomotive is different as compared to the operating mode of the first locomotive. The communication link interconnects the first and second controller and provides information corresponding to the desired operating mode to the first and second controller.

The system and method of the invention has a number of advantages over the prior art. Each locomotive of the consist can be independently controlled thereby permitting the operating parameters of the consist to be optimized. The independent control of each of the locomotives also provides flexibility. The simplicity and ease of use of the system and method of the invention is transparent to the operator so that the operator does not have to do anything differently than what the operator presently does under the prior art consist control. The system and method of the invention can also be retrofitted to existing consists. The system and method of the invention allow optimization of the operation of the consist to increase fuel efficiency, to optimize power output and to optimize the performance of each locomotive as well as the consist as a whole.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
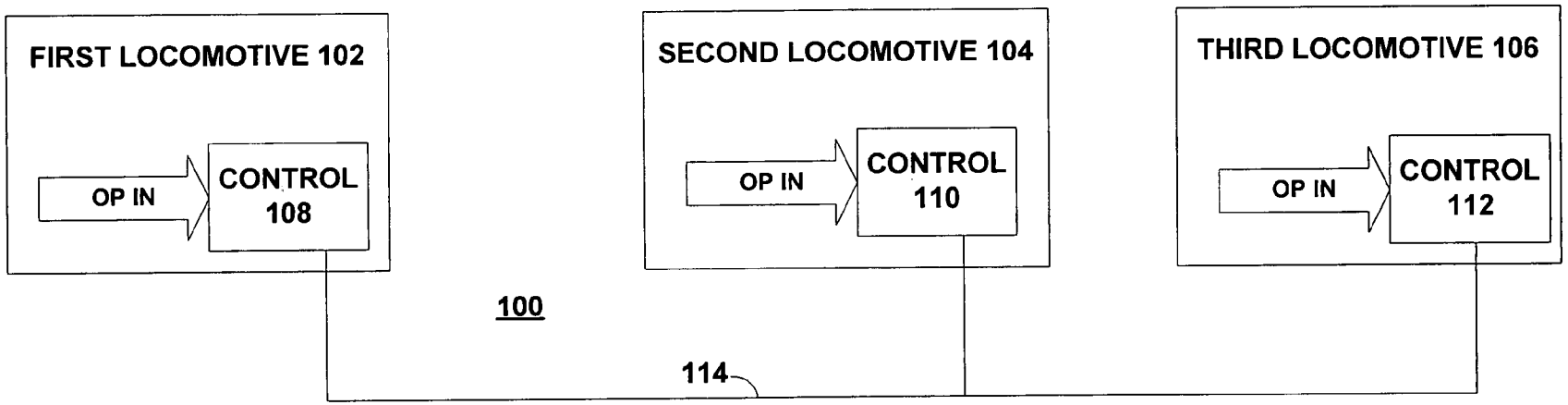
FIG. 1 is a block diagram of a system according to the invention for controlling the operation of three-locomotives of a consist.

Referring to FIG. 1, a system 100 for controlling a consist of three locomotives 102, 104, and 106 is illustrated in block diagram form. Although the system is illustrated in a context of a three-locomotive consist, it is understood that the system and method of the invention may be also implemented in a two-locomotive consist or in the consist of more than three units such as a four or more locomotive consist. The first locomotive 102 has a first locomotive control 108 that controls the operation of the locomotive. Similarly, the second locomotive 104 has a second locomotive control 110 and the third locomotive 106 has a third locomotive control 112. As shown in FIG. 1, the locomotive controls are interconnected by a communication link 114. It is contemplated that this link may be any wired or wireless link between the locomotive controls such as the MU cable which presently provides a hard wire communication link among the locomotives of a consist. For example, if the locomotive controls include microprocessors, the communication link 114 may be a network bus such as an Ethernet twisted pair cable linking the microprocessors. Alternatively, each of the locomotive controls 108, 110, and 112 may be associated with a transceiver which transmits and receives signals in communication with each other (see U.S. Pat. No. 4,582,280 noted above). The locomotive controls 108, 110, and 112 constitute an operator control for use by the operator to indicate a desired operating condition.

In its simplest form, the desired operating condition may be a notch setting at which the consist should equivalently operate. Generally, one of the units would be designated a lead unit in which the operator would ride. The operator would provide input to the control of the lead unit that would communicate corresponding input information to the other controls. FIG. 1 illustrates operator input to all three units to indicate that the operator may be riding in any one of the units and would provide the operator input via the control of the unit in which the operator is riding.

In more sophisticated systems, the operator input may include a total horsepower requirement, a fuel efficiency level, a power output requirement or a performance requirement of each of the locomotives or of the consist as a whole. In this latter, more sophisticated embodiment, the controls 108, 110 and 112 would calculate by algorithm or determine through a look-up table the level of operation of each of the locomotives. The optimization of the operation of the consist will be discussed in greater detail below. In general, the operator control may be any input device which can provide information to the linked controls of the consist. For example, the operator control may be a keyboard, a keypad, a joystick or simply a multi-position switch that would indicate a notch position.

The first locomotive control 108 responds to the desired operating mode as indicated by the operator input and controls an operating mode of the first locomotive 102. Similarly, the second locomotive control 110 responds to the desired operating mode as indicated by the operator input for controlling the operating mode of the second locomotive 104. Similarly, the third locomotive control 112 responds to the desired operating mode as indicated by the operator input for controlling an operating mode of the third locomotive 106. As shown in FIG. 1, the operator input (OP IN) may be any input that is provided to any of the controls 108, 110 or 112.

One feature of the invention is the independent setting of the controls of each of the locomotive units of the consist. As a result, in at least one mode of operation of the consist as a whole, the operating mode of the first locomotive 102 is different as compared to the operating condition of the other locomotives 104,106. For example, locomotive 102 may be operating at notch 6 whereas locomotive 104 may be operating at notch 5. In addition, the operating mode of the third locomotive is independent of the other locomotives and may be different than either or both of the locomotives. In the previously noted example, locomotive 3 may operate at notch 5, 6, or 7. The coordination of the operation of the locomotives is accomplished by the communication link 114 which interconnects the controllers and provides information corresponding to the desired operating mode to the controllers.

Figure 2:
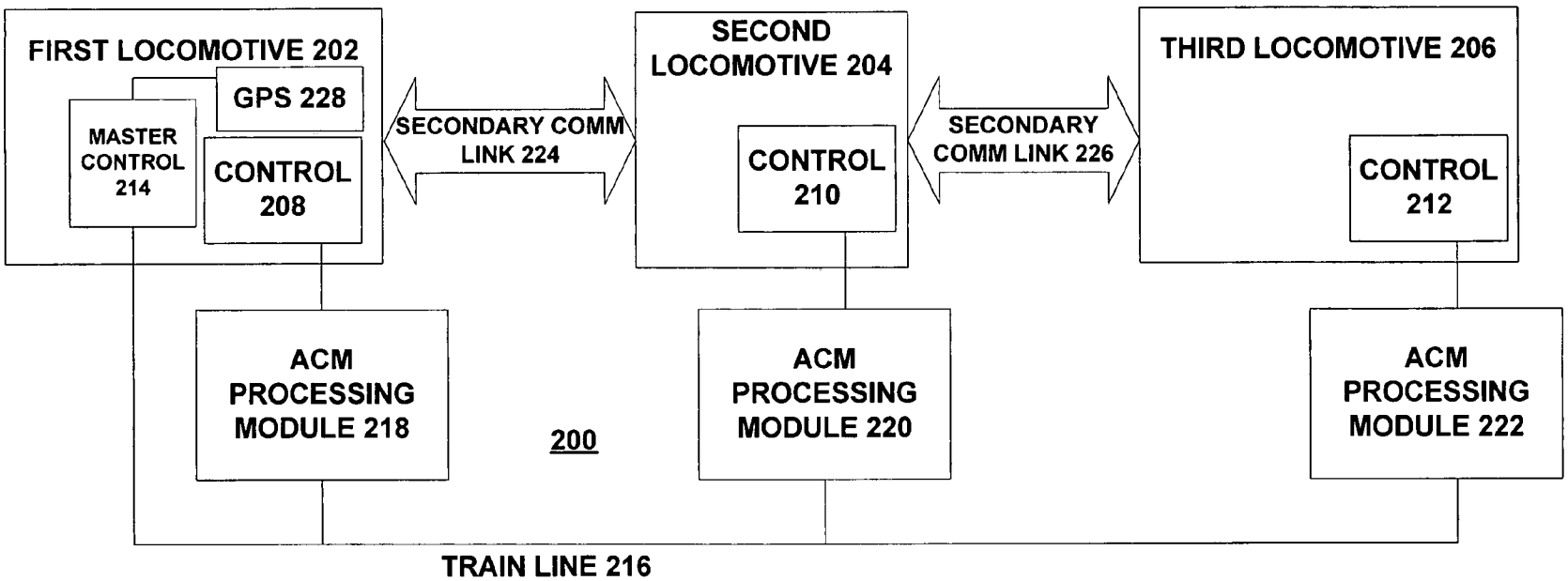
FIG. 2 is a block diagram of an alternative to the FIG. 1 embodiment that may be retrofitted to an existing three-locomotive consist.

Referring to FIG. 2, an alternative embodiment of a system and method according to the invention is illustrated. In this embodiment it is assumed that a consist of three-locomotives 202, 204, and 206 are retrofitted in order to create a system according to the invention which operates according to the method of the invention. According to the present state of the art, each locomotive 202, 204, and 206 of a consist would have its own locomotive control, 208, 210, 212, respectively. A master control 214 would be located on a lead locomotive and would be connected to the locomotive controls via a communication link such as a train line 216. When an operator in the lead locomotive 202 would set the master control 214 at a particular notch position, for example notch 6, this information would be provided via the train line 216 to the controls 208, 210, and 212. As a result, each of the locomotives 202, 204, and 206 would be operated at a notch 6 position. It is noted that the lead locomotive may not be the first locomotive, particularly in a distributed power system. In general, the lead locomotive is the one in which the operator rides.

According to the invention, an automatic consist management (ACM) processing module 218, 220, and 222 is interposed between the master control 214 and each of the locomotive controls 208, 210, and 212. The ACM processing module is preferably a microprocessor-controlled device that intelligently processes the notch command from the master control 214 and provided to each of the locomotives via the train line 216. In one alternative embodiment, the modules would have 27 inputs and 27 outputs to correspond to the wire harness of the train line and would operate according to the standard train line protocol.

In general, multiple unit control is used to designate control systems designed for the operation of two or more locomotives in a train when the locomotives are controlled simultaneously by one operator. The definition has been broadened in use to include auxiliary functions such as alarms and information transmission, such as fuel level on trailing units. The term is frequently abbreviated as MU. The wires passing through the locomotives from end receptacle to end receptacle for control purposes are known as train line wires that interconnect the MU. Each has a number and a letter designation. The numbers correspond to the receptacle pin numbers. The letter designation is more arbitrary, and for some wires may vary depending on the application, as the function of the individual wires has varied over time. Even the number of pins in the receptacle has been changed. The standard number for sometime has been 27, but 21 was common not too long ago. There have been additional train lines as well. Compatibility between various locomotives is extremely important. On passenger locomotives, separate train lines are applied for voice communication, music, car door control and so on. There have also been some non-electrical MU schemes. For example, some MU systems were pneumatic, depending on pressure control for notch control.

Solid state sensing of train line circuits has been successfully applied for many years. As with other train line circuits, the modules 218, 220, 222 must have the appropriate transient voltage rating and sneak circuit avoidance, especially in the case of accidental grounds, which may occur anywhere. The modules must also avoid freewheeling paths, which can occasionally cause problems. Operationally, the threshold between on and off sensing must be set high enough to avoid detecting leakage voltages. Even with a fairly high threshold, leakage of the MU wires of a consist can rise supposedly open and dead wires to surprising levels, in the tens of volts. With relay sensing, the load of the coils keep the voltage low and there may not be enough power available by a large margin to pick up the coil. With high impedance, solid-state circuits, voltages may exceed threshold values. To prevent this external dummy loads may be necessary. In some cases, such train lines have a 1,000 Ohm, 50/25 watt resistor connected to the neutral wire of a load. In each and every situation, the modules 218, 220, and 222 must be compatible with the MU.

For example, in one preferred embodiment, the ACM processing modules may be programmed to optimize fuel efficiency of the consist. This programming may be in the form of an algorithm which determines the best notch combination for the consist to obtain the best fuel efficiency or may be a look up table as noted below. In the three-unit consist example, when the operator sets the master control 214 at notch 6, a command is sent out at notch 6 via the train line 216 to each of the locomotive controls 208, 210, and 212. Assume further, for example, that each of the ACM processing modules 218, 220, and 222 will operate their respective locomotives according to the following Table 1.

TABLE 1

Fuel Saving for Three-Locomotive Consist

| | Current Consist Notch Combination | Total GHP Output Level | Consist Fuel Consumption Rate (Gal.) | HP/Gal/Hr | Optimized Notch Combination | Total GHP Output Level | Consist Fuel Consumption Rate (Gal.) | HP/Gal/Hr | Fuel Efficiency Improvements |
|---|---|---|---|---|---|---|---|---|---|
| 1 | N8-N8-N8 | 13500 | 629.48 | 21.45 | N8-N8-N8 | 13500 | 629.48 | 21.45 | 0% |
| 2 | N7-N7-N7 | 10980 | 509.17 | 21.56 | N7-N7-N7 | 10980 | 509.17 | 21.56 | 0% |
| 3 | N6-N6-N6 | 6820 | 421.15 | 20.94 | N8-N8-Idle | 9000 | 423.15 | 21.27 | 2% |
| 4 | N5-N5-N5 | 6660 | 330.00 | 20.14 | N7-N7-Idle | 7320 | 342.95 | 21.34 | 0% |
| 5 | N4-N4-N4 | 4650 | 233.33 | 19.93 | N8-Idle-Idle | 4500 | 216.83 | 20.75 | 4% |
| 6 | N3-N3-N3 | 3120 | 164.97 | 18.91 | N7-Idle-Idle | 3660 | 176.72 | 20.71 | 10% |
| 7 | N2-N2-N2 | 1500 | 81.21 | 18.47 | N2-N2-N2 | 1500 | 81.21 | 18.47 | 0% |
| 8 | N1-N1-N1 | 600 | 34.03 | 17.23 | N1-N1-N1 | 600 | 34.83 | N/A | 0% |

As a result of the information provided by the above table, the ACM processing module 218 will map the notch 6 command that it receives for the lead unit as a notch 8 command which will be provided to the locomotive control 208 to operate the first locomotive 202 at notch 8. Similarly, the ACM processing module 220 will interpret the notch 6 command received from the master control 214 via the train line 216 as a notch 8 command that will be provided to locomotive control 210. As a result, the second locomotive will also be operating at a notch 8 position. In contrast and independently, the ACM processing module 222 will interpret the notch 6 command as an idle command which will be provided to the locomotive control 212 so that the third locomotive 206 will operate in an idle mode. By running at an N8-N8-idle combination, the locomotive consist has a higher fuel efficiency than one operating at an N6-N6-N6 combination. As shown in line 3 of the above-noted table, the total group horsepower (GHP) output level for an N6-N6-N6 current consist notch would be 8820 at a fuel consumption rate of 421.15 gallons providing a horsepower/gallon/hour rate of 20.94. In contrast, an optimized notch combination of N8-N8-idle provides a total GHP output level of 9000 with a consist fuel consumption rate of 423.15 gallons so that the HP/Gal/Hr rate is 21.27. This provides a two percent increase in fuel efficiency. Alternatively, an N7-N7-N4 may be employed to obtain a similar fuel savings at the same GHP output level. Similar savings can be achieved by developing tables or algorithms for a consist of two, four or more locomotives. For example, the following Table 2 illustrates the fuel savings for a two-locomotive consist according to the invention.

TABLE 2

Fuel Saving for Two-Locomotive Consist

| | Current Notch Combination | Total GHP Output Level | Consist Fuel Consumption Rate (Gal/Hr) | Fuel Efficiency HP/Gal/Hr | Optimized Notch Combination | Total GHP Output Level | Consist Fuel Consumption Rate (Gal/Hr) | Fuel Efficiency HP/Gal/Hr | Fuel Efficiency Improvements |
|---|---|---|---|---|---|---|---|---|---|
| 1 | N8-N8 | 9000 | 419.65 | 21.45 | N8-N8 | 9000 | 419.65 | 21.45 | 0% |
| 2 | N7-N7 | 7320 | 339.45 | 21.56 | N7-N7 | 7320 | 339.45 | 21.50 | 0% |
| 3 | N6-N6 | 5880 | 280.77 | 20.94 | N6-N6 | 5880 | 280.77 | 20.94 | 0% |
| 4 | N5-N5 | 4440 | 220.46 | 20.14 | N8-Idle | 4500 | 213.33 | 21.09 | 5% |
| 5 | N4-N4 | 3100 | 155.55 | 19.93 | N6-Idle | 2940 | 143.88 | 20.43 | 3% |
| 6 | N3-N3 | 2080 | 109.98 | 18.91 | N5-Idle | 2220 | 113.73 | 19.52 | 3% |
| 7 | N2-N2 | 1000 | 54.14 | 18.47 | N2-N2 | 1000 | 54.14 | 18.47 | 0% |
| 8 | N1-N1 | 400 | 23.22 | 17.23 | N1-N1 | 400 | 23.22 | 17.23 | 0% |

As shown in FIG. 2, it is contemplated that an optional feature of the invention may include a secondary communication link 224 and 226 between the controls. This link may be used to pass other locomotive operational information, such as fuel level, tract of effort and locomotive status, between the ACM processing modules and/or between the locomotive controls 208, 210, and 212. The exchanged information may be used by the ACM processing modules to cooperate with miscellaneous locomotive operation situations and maximize benefit of the system 200 according to the invention.

It is noted that the tables above demonstrate various notch combinations that can be used for more fuel efficient operation of a locomotive consist and further indicate the estimated fuel improvement. The tables above are based on a fuel savings analysis for a GE Dash 9 locomotive and an AC4400 locomotive. The same or similar analysis can be applied to other locomotives such as the GE Dash 8 and the EMD microprocessor controlled locomotives.

From the above it can be seen that several features of the invention are achieved. For example, a total fuel savings of at least 1–2% can be obtained by independently controlling the notch positions of the various locomotives, depending on a consist duty cycle. By way of example, it is noted that in the lower notch positions, fuel savings or independent operation may not be desirable. Accordingly, in certain modes of operation, the system and method of the invention may not vary the notch positions of the various locomotives so that the notch positions may be the same for all locomotives within the consist. From an operator's point of view, no additional operating action steps are required. Since the operator/locomotive interface remains unchanged and the operator is merely controlling the master control 214, the system of the invention and its method of operation are transparent to the operator.

Although the above example has been described with respect to the optimization of fuel efficiency, it is contemplated that any operating parameter of the consist may be optimized or minimized depending on the desirable outcome needed. For example, the notch positions of the locomotives of the consist may be independently controlled to minimize emissions or other less desirable output aspects of the consist.

It is also contemplated that several features regarding the operating parameters of the consist may be taken into account in determining the particular notch positions of the various locomotives of the consist. In other words, more than one operating parameter of the consist may be optimized according to the invention. For example, it may be desirable to reduce noise in the lead unit where the operator and crew are located thereby minimizing noise in the operator cab and increasing crew comfort. This can be accomplished by minimizing utilization of the lead unit or maximizing lead unit idling time or maximizing the use of one of the other locomotives other than the lead unit. In the example noted above where the operator commands a notch position of 6, an implemented notch arrangement of idle-N8-N8 may be accomplished to achieve this aspect of the invention.

Another operating parameter that needs to be considered is the operating time of any one unit of the consist as well as the total operating time of any one unit of the consist. To avoid excessive usage of any one unit of the consist, the utilization of locomotives may be rotated depending on relative fuel level of each unit in the consist. In addition, newer locomotives with less operating time can be favored over older locomotives with more operating time in their history. In addition, if these similar locomotives are part of the consist, locomotives with higher efficiency may be favored over locomotives with lower efficiency.

As an alternative feature of the invention it is contemplated that the system may notify the operator whenever the number of ACM system equipped units in a consist is greater than one, even though some of the units which are present in the consist may not be ACM equipped. It is also contemplated that in certain situations the ACM system may be disabled such as when the train speed is too low, when wheel slip is detected or when certain faults are logged into any units.

Although the above discussion generally relates to optimizing fuel consumption as the desired operating mode which is optimized, the invention contemplates that any parameter of the consist may be optimized or minimized or maximized depending on the situation. For example, in certain situations, power output or performance of the locomotives may be optimized. In addition, many consists include a global positioning system (GPS) link 228 which indicates a position of the consist so that the terrain on which the train is traversing is known. In this situation, it is contemplating that the operating mode may be optimized as a function of the position of the consist as indicated by the GPS system. As a specific example, suppose that a consist of four locomotives is spread throughout a mile long train so that at some point in the trip some of the locomotives are traveling uphill while others are traveling downhill. If acceleration, coasting or braking is required at that point, it may be preferable to vary the power modes of operation of each of the locomotives of the consist to achieve an desired, optimal result.

In one form, the invention includes a method for controlling a consist of at least first and second locomotives having discrete operating modes. The controlling method would include the following steps. First, an operator would indicate a desired operating mode of the consist such as a notch position, e.g., N6. Either manually or automatically, a discrete mode for the first locomotive would be selected as a function of the indicated, desired operating mode. For example, in the case of a two-locomotive consist and referring to Table 2, line 4, a desired operating mode of N5 suggests the first locomotive should operate at N8. Next, a discrete operating mode for the second locomotive would also be selected as a function of the indicated, desired operating mode. In the case of an N5 indication, the second locomotive according to Table 2 would be operated at an idle. As a result, in response to the indicated, desired operating mode, a selected mode of operation of the first locomotive (e.g., N8) is different than the selected mode of operation of the second locomotive (e.g., idle).

Although the invention has been described above as being implemented by a look up table such as illustrated in Tables 1 and 2, it is also contemplated that other information may be taken into account in determining how to implement the invention. For example, as noted above, algorithms may be used to calculate optimum combinations. Alternatively, many locomotives have known profiles of operation or have profiles of operation which can be determined or which can be monitored over time to be determined. Such profiles may be used in establishing a look up table for consist operation or for defining an algorithm. It is also contemplated that the ACM processing module may develop a unique profile for its associated locomotive and that the profile would be used to determine locomotive operation in combination with the profiles of the other locomotives of the consist. Furthermore, the profile may be dynamic in the sense that the ACM processing module may adjust or modify the profile according to the time of year or age of the locomotive or other variables. As an example, assume that a performance profile of the first and second locomotives is known. In this situation, the first and second operating modes for the first and second locomotives may be selected to optimize the performance parameter as a function of the known profiles.

It is also contemplated that the system and method of the invention may be implemented as a retrofitted kit to an existing consist. For example, in a prior art system for controlling in response to an operator, a consist including a first locomotive 202 and a second locomotive 204, the master control 214 constitutes an operator control for use by the operator to indicate a desired operating mode of the consist. The first controller 208 controls an operating mode of the first locomotive 202. The second control 210 controls an operating mode of the second locomotive 204. The train line 216 communicates a desired operating mode of the consist as indicated by the master control 214 to the first and second controllers 208, 210, respectively. The retrofitted system according to the invention includes a first module 218 between the master control 214 and the first control 208. The first module 218 receives the desired operating mode from the master control 214 via the train line 216 and selectively provides a first modified operating mode to the first controller 208 for use in controlling the first locomotive 202. Depending on the table or algorithm used to adjust the notches, the module 218 would either increase, decrease or maintain at the same level the notch indication provided to the first control 208 as compared to the desired notch indication from the master control 214. A second module 220 is interposed between the master control 214 and the second control 210. The second module, as with the first module, receives a desired operating mode via the train line 216 and selectively provides a second modified operating mode to the second controller 210. In at least one mode of operation of the consist, the operating mode of the first and second locomotives is different as compared to the desired operating mode of the consist. For example, if the system is operating according to Table 2, lines 4, 5, and 6, a consist operating mode of N3, N4 or N5 will result in an operating mode of N5-idle, N6-idle or N8-idle for the first and second locomotives, respectively.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A retrofit system for controlling a consist of at least a first locomotive and a second locomotive, said consist having a master control for indicating a desired operating mode of the consist, a communication link for providing command information corresponding to the desired operating mode from the master control to a first locomotive control and a second locomotive control, and wherein the first locomotive control is responsive to operator input provided to the master control to control the operating mode of the first locomotive, and wherein the second locomotive control is responsive to operator input provided to the master control to control the operating mode of the second locomotive, said operator input indicating a desired operating mode from a plurality of operating modes, said retrofit system comprising:

a performance profile for storing previous operating time information for each of the first and second locomotives, said performance profile being coupled to the communication link;

a first processing module coupled to the communication link and responsive the desired operating mode from the master control to selectively provide a modified operating mode to the first locomotive control, and wherein the first locomotive control is responsive to the first modified operating mode to determine a mode of operation of the first locomotive;

a second processing module coupled to the communication link and responsive to the desired operating mode from the master control to selectively provide a modified operating mode to the second locomotive control, wherein the second locomotive control is responsive to the second modified operating mode to determine a mode of operation of the second locomotive, and wherein, in at least one mode of the plurality of operating modes, the modified operating mode of the second locomotive is different as compared to the modified operating mode of the first locomotive; and wherein the first and second processing modules access the performance profile to determine the operating mode of the first and second locomotives, respectively, as a function of the previous operating time information of each of the first and second locomotives.

2. The system of claim 1, wherein the modified operating mode of the first locomotive corresponds to a first throttle setting and the modified operating mode of the first locomotive corresponds to a second throttle setting, wherein the first throttle setting is greater than the second throttle setting when the previous operating time of operation of the first locomotive is less than the previous operating time of the second locomotive, and wherein the first throttle setting is less than the second throttle setting when the previous operating time of the first locomotive is greater than the previous operating time of the second locomotive.

3. The system of claim 1, wherein the first locomotive is a lead locomotive operating at a first operating mode, and wherein the second locomotive is a trail locomotive operating at a second operating mode.

4. The system of claim 1 further comprising a link to a GPS indicating a position of the consist and wherein the operating mode of the first and second locomotives is a function of the position of the consist as indicated by the GPS.

5. The system of claim 1, wherein the operating mode of the first and second locomotives is a function of a location of the crew member such that the operating mode of a locomotive in which a crew member is riding is less than an operating mode of a locomotive in which a crew member is not riding.

6. The system of claim 1, wherein the communication link providing command information from the master control is comprised of a wired communication facility.

7. The system of claim 1, wherein the communication link providing command information from the master control is comprised of a wireless communication facility.

8. The system of claim 1, wherein first and second processing modules further determine the operating mode of the first and second locomotives, respectively, as a function of a determined fuel consumption rate of at least one of the first and second locomotives.

9. The system of claim 1, wherein first and second processing modules further determine the operating mode of the first and second locomotives, respectively, as a function of a determined power consumption rate of at least one of the first and second locomotives.

10. A retrofit system for controlling a consist of at least a first locomotive and a second locomotive, said consist having a master control for indicating a desired operating mode of the consist and a communication link for providing command information corresponding to the desired operating mode from the master control to a first locomotive control mid a second locomotive control, wherein the first locomotive control is responsive to operator input provided to the master control to control the operating mode of the first locomotive, and wherein the second locomotive control is responsive to operator input provided to the master control to control the operating mode of the second locomotive, said operator input indicating a desired operating mode from a plurality of operating modes, said retrofit system comprising:

a performance profile for storing age information for each of the first and second locomotives, said performance profile being coupled to the communication link;

a first processing module coupled to the communication link and responsive the desired operating mode from the master control to selectively provide a modified operating mode to the first locomotive control, and wherein the first locomotive control is responsive to the first modified operating mode to determine a mode of operation of the first locomotive;

a second processing module coupled to the communication link and responsive to the desired operating mode from the master control to selectively provide a modified operating mode to the second locomotive control, wherein the second locomotive control is responsive to the second modified operating mode to determine a mode of operation of the second locomotive, and wherein, in at least one mode of the plurality of operating modes, the modified operating mode of the second locomotive is different as compared to the modified operating mode of the first locomotive; and wherein the first and second processing modules access the performance profile to determine the operating mode of the first and second locomotives, respectively, as a function of the age information of each of the first and second locomotives.

11. The system of claim 10, wherein the modified operating mode of the first locomotive corresponds to a first throttle setting and the modified operating mode of the first locomotive corresponds to a second throttle setting, wherein the first throttle setting is greater than the second throttle setting when the age of the first locomotive is less than the age of the second locomotive, and wherein the first throttle setting is less than the second throttle setting when the age of the first locomotive is greater than age of the second locomotive.

12. The system of claim 10, wherein the performance profile further defines a power consumption rate of the first locomotive and the second locomotive, and wherein the first and second processing modules determines the power consumption rate for the first and second locomotives, respectively, from the performance profile.

13. The system of claim 10, wherein the first locomotive is a lead locomotive operating at a first operating mode, and wherein the second locomotive is a trail locomotive operating at a second operating mode.

14. The system of claim 10, further comprising a link to a GPS indicating a position of the consist and wherein the operating mode of the first and second locomotives is a function of the position of the consist as indicated by the GPS.

15. The system of claim 10, wherein the operating mode of the first and second locomotives is a function of a location of the crew member such that the operating mode of a locomotive in which a crew member is riding is less than an operating mode of a locomotive in which a crew member is not riding.

16. The system of claim 10, wherein the communication link providing command information from the master control is comprised of a wired communication facility.

17. The system of claim 10, wherein the communication link providing command information from the master control is comprised of a wireless communication facility.

18. The system of claim 10, wherein first and second processing modules further determine the operating mode of the first and second locomotives, respectively, as a function of a determined fuel consumption rate of at least one of the first and second locomotives.

19. The system of claim 10, wherein first and second processing modules further determine the operating mode of the first and second locomotives, respectively, as a function of a determined power consumption rate of at least one of the firs and second locomotives.

* * * * *

UNITED STATES PATENT AND TRADEMARK OFFICE

CERTIFICATE OF CORRECTION

PATENT NO. : 7,021,589 B2
APPLICATION NO. : 10/722610
DATED : April 4, 2006
INVENTOR(S) : Hess, Jr. et al.

It is certified that error appears in the above-identified patent and that said Letters Patent is hereby corrected as shown below:

Col. 10, claim 10, line 63, “mid a” should read -- and a --

Col. 12, claim 19, line 38, “firs” should read -- first --

Signed and Sealed this

Seventh Day of November, 2006

JON W. DUDAS
*Director of the United States Patent and Trademark Office*